US007208890B2

(12) United States Patent
Zavadtsev et al.

(10) Patent No.: US 7,208,890 B2
(45) Date of Patent: Apr. 24, 2007

(54) MULTI-SECTION PARTICLE ACCELERATOR WITH CONTROLLED BEAM CURRENT

(75) Inventors: Alexandre A. Zavadtsev, Moscow (RU); Gary F. Bowser, Auburn, IN (US)

(73) Assignee: Scan Tech Holdings, LLC, Atlanta, GA (US)

( * ) Notice: Subject to any disclaimer, the term of this patent is extended or adjusted under 35 U.S.C. 154(b) by 0 days.

(21) Appl. No.: 10/529,277

(22) PCT Filed: Sep. 29, 2003

(86) PCT No.: PCT/US03/30646

§ 371 (c)(1),
(2), (4) Date: Mar. 25, 2005

(87) PCT Pub. No.: WO2004/030425

PCT Pub. Date: Apr. 8, 2004

(65) Prior Publication Data

US 2005/0212465 A1 Sep. 29, 2005

Related U.S. Application Data

(60) Provisional application No. 60/414,300, filed on Sep. 27, 2002.

(51) Int. Cl.
*H01J 23/00* (2006.01)

(52) U.S. Cl. ..... 315/500; 315/501; 315/507; 315/5.51; 315/5.41

(58) Field of Classification Search ..... 315/5.41, 315/5.52, 500, 501, 505–507; 250/396 R; 313/360.1; 330/4.7
See application file for complete search history.

(56) References Cited

U.S. PATENT DOCUMENTS

| | | | | |
|---|---|---|---|---|
| 3,398,375 | A * | 8/1968 | Haimson | 315/505 |
| 3,423,684 | A * | 1/1969 | Purser | 315/506 |
| 4,006,422 | A * | 2/1977 | Schriber | 315/505 |
| 4,835,446 | A * | 5/1989 | Nation et al. | 315/5.13 |
| 5,381,072 | A * | 1/1995 | Tanabe | 315/5.41 |
| 5,744,919 | A * | 4/1998 | Mishin et al. | 315/505 |
| 5,825,140 | A * | 10/1998 | Fujisawa | 315/505 |

* cited by examiner

*Primary Examiner*—Haissa Philogene
(74) *Attorney, Agent, or Firm*—Coursey IP Law P.C.; R. Stevan Coursey, Esq.

(57) ABSTRACT

A particle accelerator system, including apparatuses and methods, that is configurable through repositioning of shorting devices therein to operate at different charged particle beam currents while maintaining optimum transfer of electromagnetic power from electromagnetic waves to one or more accelerating sections thereof, and reducing or eliminating reflections of electromagnetic waves. The particle accelerator system includes at least two accelerating sections and an electromagnetic drive subsystem with portions of the electromagnetic drive subsystem being interposed physically between the accelerating sections, thereby making the particle accelerator system compact. The electromagnetic drive subsystem includes, among other components, a 3 dB waveguide hybrid junction having a coupling window in a narrow wall thereof which is shared by the junction's rectangular-shaped waveguides. By virtue of the coupling window being positioned in a narrow wall rather than a wide wall, the maximal power of the 3 dB waveguide hybrid junction is increased significantly.

8 Claims, 3 Drawing Sheets

MULTI-SECTION PARTICLE ACCELERATOR WITH CONTROLLED BEAM CURRENT

CROSS REFERENCE TO RELATED APPLICATION

This application is a national phase application under 35 U.S.C. §371 of international patent application number PCT/US03/030646 entitled "Multi-Section Particle Accelerator with Controlled Beam Current" filed on Sep. 29, 2003, now expired, and claims the benefit of priority to U.S. provisional patent application Ser. No. 60/414,300 entitled "Two Section Particle Accelerator with Controlled Beam Current" filed on Sep. 27, 2002, now expired.

FIELD OF THE INVENTION

The present invention relates, generally, to the field of particle accelerators and, more specifically, to particle accelerators having controlled beam current.

BACKGROUND OF THE INVENTION

Standing wave linear accelerators with controlled beam current are utilized in a wide variety of medical and industrial applications, including, radiography, radiotherapy, medical instrument sterilization, food irradiation, and dangerous substance neutralization. In such applications, available space is often limited and, hence, it is desirable that the accelerators be compact. For example, in a medical radiotherapy application, an accelerator, electron gun, and target are installed in an x-ray head of a movable gantry which may be moved around a patient lying on a table to direct x-ray radiation at an appropriate location of the patient's body. To achieve a sufficiently large area of irradiation with the required dose uniformity, the distance between the target and the patient should be as large as possible. In order to maximize the distance between the target and the patient, it is advantageous for the accelerator to have a short structure length and, hence, a high accelerating gradient to produce a beam of charged particles having an appropriate energy level in such a short structure.

In typical standing wave linear accelerators often used in such applications, the standing wave linear accelerators comprise multiple accelerating sections with each accelerating section having an alternating series of connected accelerating and coupling cavities that form a biperiodic structure. An injector emits charged particles into an accelerating section and the charged particles are accelerated as they travel in a charged particle beam through the accelerating sections by electromagnetic fields present therein. The electromagnetic fields are created by electromagnetic power (i.e., in the form of radio frequency (RF) waves) that is produced by an RF generator (for example, a magnetron) and delivered to the accelerating sections by feeding waveguides which, generally, comprise hollow pipes having a rectangular cross-section.

Unfortunately, reflections of the electromagnetic wave are often produced in the feeding waveguides with the extent of such reflections being dependent, at least in part, upon the coupling coefficients between the feeding waveguides and accelerating sections. To make matters worse, for an accelerator operating at a particular beam current, there is only one value of the coupling coefficient between a feeding waveguide and an accelerating section at which all of the power of the electromagnetic wave present in the feeding waveguide is delivered to the accelerating section without reflections. Because the coupling coefficient between each feeding waveguide and respective accelerating section is constant and cannot be changed in the known accelerators for operation at different beam currents, reflections are generated which may travel back to and damage the accelerator's magnetron and, hence, all of the power delivered by each feeding waveguide (i.e., in the form of an electromagnetic wave) is not maximally utilized for particle acceleration.

To prevent such reflections from traveling back to the RF generator, some accelerator manufacturers have employed ferrite isolators or circulators to isolate the RF generator from the accelerating sections and feeding waveguides. However, ferrite isolators and circulators are expensive and their use results in RF power losses and, hence, decreased accelerator efficiency. As an alternative to ferrite isolators and circulators, the 3 dB waveguide hybrid junction was developed for use between the RF generator and the feeding waveguides. A 3 dB waveguide hybrid junction, generally, includes two parallel waveguides having rectangular cross-sections such that each waveguide, therefore, has two walls which are wider than the other two walls thereof (i.e., the wider walls being referred to sometimes herein as "wide walls"). One of the wide walls of each such waveguide comprises a common wide wall therebetween which is shared by both waveguides. Therefore, the parallel waveguides are oriented adjacent to one another by virtue of the shared, common wide wall. In addition, a 3 dB waveguide hybrid junction typically includes a coupling hole, or window, in the shared, common wide wall. When installed in an accelerator having two accelerating sections, a first end of the first waveguide of the 3 dB waveguide hybrid junction is connected to the magnetron output and a second end of the first waveguide is often connected to still another waveguide that, in turn, connects to one of the accelerating sections of the accelerator. A first end of the second waveguide of the 3 dB waveguide hybrid junction is connected to a waveguide load which receives electromagnetic power and a second end of the second waveguide is often connected to still another waveguide that connects to another of the accelerating sections of the accelerator.

In operation, the 3 dB waveguide hybrid junction receives input electromagnetic power from the RF generator through the first end of the first waveguide. A first portion of the electromagnetic power travels through the first waveguide to its second end and then to an accelerating section via another connected waveguide. A second portion of the electromagnetic power travels through the coupling window in the junction's common wide wall and into the junction's second waveguide and then travels through the second end of the second waveguide and on to a different accelerating section via another connected waveguide. Reflections of electromagnetic waves received through the second end of the junction's first waveguide are directed through the coupling window and into the second waveguide. Reflections of electromagnetic waves received through the second end of the second waveguide and reflections received through the coupling window are directed through the first end of the second waveguide to the waveguide load, thereby protecting the RF generator from potential damage.

While the 3 dB waveguide hybrid junction serves to protect the RF generator, high electrical fields are present along the junction's wide wall and at the edges of the coupling window therein. Thus, by virtue of the coupling window being positioned in the junction's wide wall, the maximal power of the 3 dB waveguide hybrid junction is limited. Also, the turns or bends in the waveguides that often connect the 3 dB waveguide hybrid junction to the accelerating sections of an accelerator results in the accelerator having larger overall dimensions, making the accelerator less desirable for the applications described above.

Therefore, there exists in the industry, a need for a particle accelerator that is compact, that makes maximal use of electromagnetic power to accelerate charged particles at different beam currents, and that does not include a 3 dB waveguide hybrid junction with limited maximal power, that addresses these and other problems or difficulties which exist now or in the future.

SUMMARY OF THE INVENTION

Broadly described, the present invention comprises a particle accelerator system with controlled charged particle beam current and methods of operating same. More particularly, the present invention comprises a particle accelerator system which is configurable to operate at different charged particle beam currents while maintaining optimum transfer of electromagnetic power from an RF generator to one or more accelerating sections thereof and reducing or eliminating reflections of electromagnetic waves. The particle accelerator system of the present invention includes at least two accelerating sections and an electromagnetic drive subsystem with portions of the electromagnetic drive subsystem being interposed physically between the accelerating sections. The electromagnetic drive subsystem includes, among other components, a 3 dB waveguide hybrid junction having a coupling window in a wide wall thereof which is shared by the junction's waveguides.

Advantageously, the particle accelerator system includes movable shorting devices which are positionable in a plurality of positions relative to the accelerator system's longitudinal axis, thereby enabling the coupling coefficients between the accelerator system's feeder waveguides and accelerating sections to be changed by moving the shorting devices into different positions. Because there is only one value of the coupling coefficients between the feeder waveguides and the accelerating sections at which all of the power of the electromagnetic waves of the feeder waveguides is delivered to the accelerating sections without reflections and is maximally utilized for charged particle acceleration for each charged particle beam current at which the particle accelerator system is operated, the movability of the movable shorting devices into a plurality of positions allows optimal setting of the coupling coefficients for operation of the particle accelerator system at any charged particle beam current desired and, hence, allows the particle accelerator system to be operated at a plurality of different charged particle beam currents at peak efficiency. When the coupling coefficients are so optimized, the magnitude of the longitudinal component of the electric field produced at the accelerator system's longitudinal axis is also optimized at a maximum.

Also advantageously, the particle accelerator system includes an electromagnetic drive subsystem having feeder waveguides which are physically interposed between the system's accelerating sections. A drift tube formed in a common narrow wall shared by the feeder waveguides enables charged particles to travel between the accelerating sections during the system's operation. The common narrow wall shared by the feeder waveguides is also shared by the waveguides of a 3 dB waveguide hybrid junction, thereby causing each of the feeder waveguides to be connected to a respective waveguide of the 3 dB waveguide hybrid junction in a coaxial relationship. By virtue of the feeder waveguides being interposed physically between the system's accelerating sections and by virtue of the coaxial relationship of the feeder waveguides and respective waveguides of the 3 dB waveguide hybrid junction (i.e., thereby requiring no turns, or bends, in the waveguides and, hence, less power loss in the waveguides), the particle accelerator system of the present invention is more compact and more efficient than other known particle accelerator systems.

Further, the particle accelerator system's 3 dB waveguide hybrid junction includes a coupling window in the common narrow wall shared by the feeder waveguides and the junction's waveguides. Because the coupling window is located in a narrow wall of the junction's waveguides as opposed to being located in a wide wall of the junction's waveguides, the maximal power of the junction is significantly higher than that of other known 3 dB waveguide hybrid junctions having a coupling window in a wide wall thereof.

Other advantages and benefits of the present invention will become apparent upon reading and understanding the present specification when taken in conjunction with the appended drawings.

DETAILED DESCRIPTION OF THE INVENTION

Figure 1:
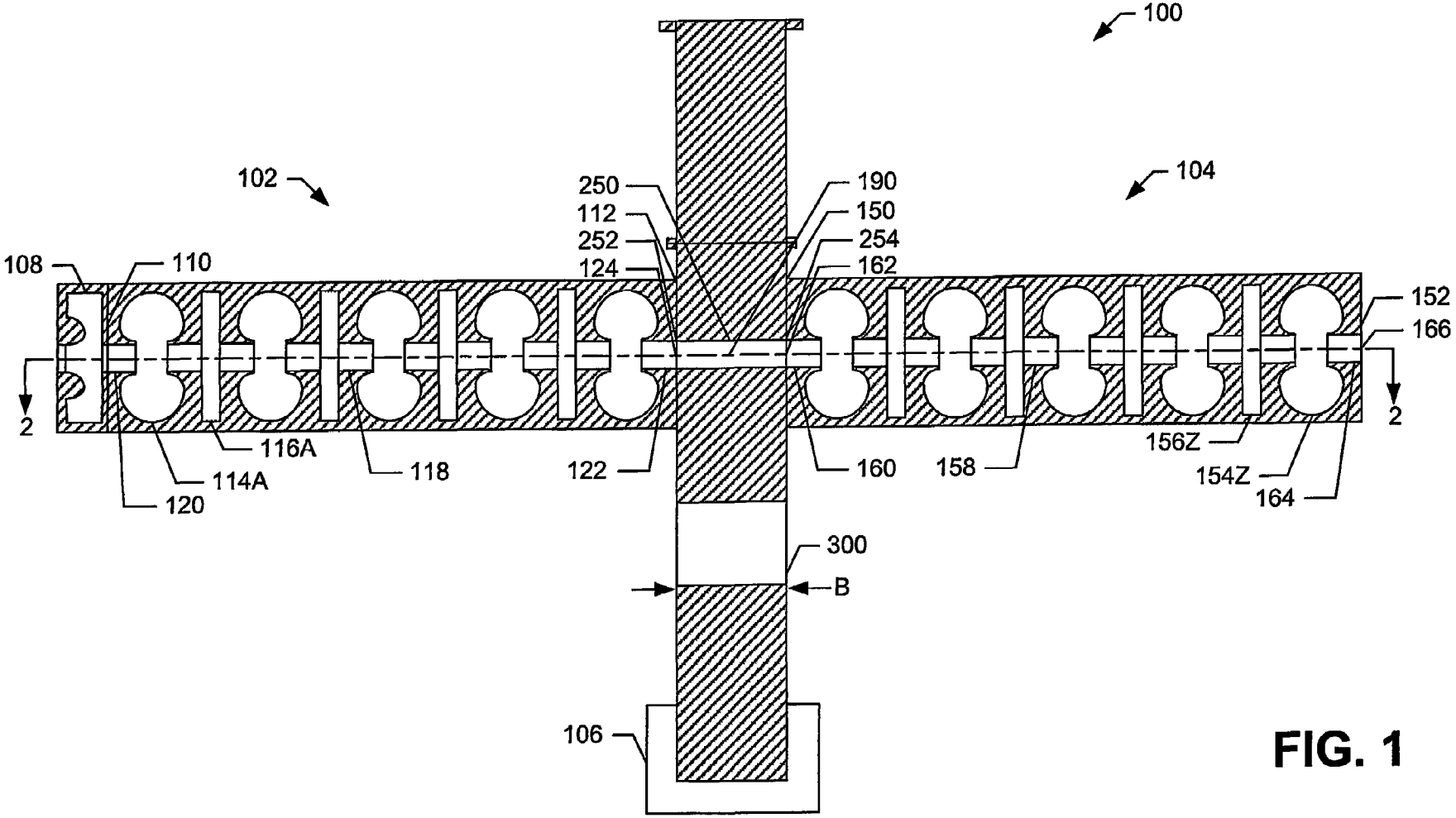
FIG. 1 displays a schematic sectional view of a particle accelerator system in accordance with an exemplary embodiment of the present invention.

Referring now to the drawings in which like numerals represent like elements or steps throughout the several views, FIG. 1 displays a schematic sectional view of a particle accelerator system 100 in accordance with an exemplary embodiment of the present invention. The particle accelerator system 100 comprises a first accelerating section 102, a second accelerating section 104, an electromagnetic drive subsystem 106, and an injector 108. Preferably, the first and second accelerating sections 102, 104 comprise standing-wave accelerating sections 102, 104 having a biperiodic accelerating structure which are operable to accelerate charged particles through the transfer of energy from electromagnetic power provided by the electromagnetic drive subsystem 106.

The first accelerating section 102 has a first end 110 and a second end 112, and includes a plurality of accelerating cavities 114 and a plurality of coupling cavities 116 arranged in an axial arrangement. A coupling cavity 116 is interposed between consecutive pairs of accelerating cavities 114. Each adjacent accelerating cavity 114 and coupling cavity 116 are connected by a respective drift tube 118 which is adapted to direct charged particles between each adjacent accelerating cavity 114 and coupling cavity 116. Each adjacent accelerating cavity 114 is RF coupled to the adjacent coupling cavity 116 via two coupling slots (not shown). The injector 108 is positioned proximate the first end 110 of the first accelerating section 102 and is connected to a first accelerating cavity 114A of the first accelerating section 102 by a drift tube 120. The injector 108 is operable to generate charged particles and to emit them into the first accelerating cavity 114A via drift tube 120. Preferably, the injector 108 is operable to generate and emit charged particles comprising electrons. The first accelerating section 102 also includes a drift tube 122 connected to the last accelerating cavity 114Z thereof and extending between the last accelerating cavity 114Z and an output port 124 located at the second end 112 of the first accelerating section 102. Drift tube 122 and output port 124 are adapted to direct charged particles from the first accelerating section 102 into a drift tube 250 of the electromagnetic drive subsystem 106, as described below, for delivery to the second accelerating section 104. The first accelerating section 102 defines an oblong-shaped slot 126 which couples the last accelerating cavity 114Z to a feeder waveguide 204 of the electromagnetic drive subsystem 106 to enable electromagnetic power to propagate from the feeder waveguide 204 into the last accelerating cavity 114Z and through the other accelerating cavities 114 and coupling cavities 116 in a direction generally toward the injector 108 and the first end 110 of the first accelerating section 102.

Similar to the first accelerating section 102, the second accelerating section 104 has a first end 150 and a second end 152, and includes a plurality of accelerating cavities 154 and a plurality of coupling cavities 156 arranged in an axial arrangement. A coupling cavity 156 is interposed between consecutive pairs of accelerating cavities 154. Each adjacent accelerating cavity 154 and coupling cavity 156 are connected by a respective drift tube 158 which is adapted to direct charged particles between each adjacent accelerating cavity 154 and coupling cavity 156. Each adjacent accelerating cavity 154 is RF coupled to the adjacent coupling cavity 156 via two coupling slots (not shown). The second accelerating section 104 also includes a drift tube 160 connected to the first accelerating cavity 154A thereof and extending between the first accelerating cavity 154A and an input port 162 located at the first end 150 of the second accelerating section 104. Drift tube 160 and input port 162 are adapted to receive charged particles from a drift tube 250 of the electromagnetic drive subsystem 106, as described below, and to direct them toward the first accelerating cavity 154A. Additionally, the second accelerating section 104 includes a drift tube 164 connected to the last accelerating cavity 154Z thereof which extends between the last accelerating cavity 154Z and an output port 166 located at the second end 152 of the second accelerating section 104. Drift tube 164 and output port 166 are adapted to direct charged particles from the second accelerating section 104 (and, hence, from the particle accelerator system 100) toward a desired target or other object. The second accelerating section 104 defines an oblong-shaped slot 168 which couples the first accelerating cavity 154A to a feeder waveguide 206 of the electromagnetic drive subsystem 106 to allow electromagnetic power to propagate from the feeder waveguide 206 into the first accelerating cavity 154A and through the other accelerating cavities 154 and coupling cavities 156 in a direction generally toward the second end 152 of the second accelerating section 104.

The accelerating cavities 114, 154 and coupling cavities 116, 156 of the first and second accelerating sections 102, 104 are, as described briefly above, arranged in an axial arrangement. As seen in FIG. 1, drift tubes 118, 120, 122 and output port 124 of the first accelerating section 102 and input port 162, drift tubes 158, 160, 164, and output port 166 of the second accelerating section 104 define a longitudinal axis 190 of the particle accelerator system 100 along which charged particles principally travel in a charged particle beam during operation of the particle accelerator system 100. It should be noted that while the figures and accompanying description of the present application display and describe a particle accelerator system 100 having accelerating sections 102, 104 having accelerating cavities 114, 154 and coupling cavities 116, 156 which are arranged in an axial arrangement, the scope of the present invention further comprises particle accelerator systems having accelerating cavities and coupling cavities arranged in a different arrangement, including, without limitation, an arrangement in which coupling cavities are side-coupled to the accelerating cavities. It should also be noted that the scope of the present invention further comprises particle accelerator systems having more than two accelerating sections and accelerating sections having different numbers of accelerating cavities and coupling cavities than those described herein.

Figure 2:
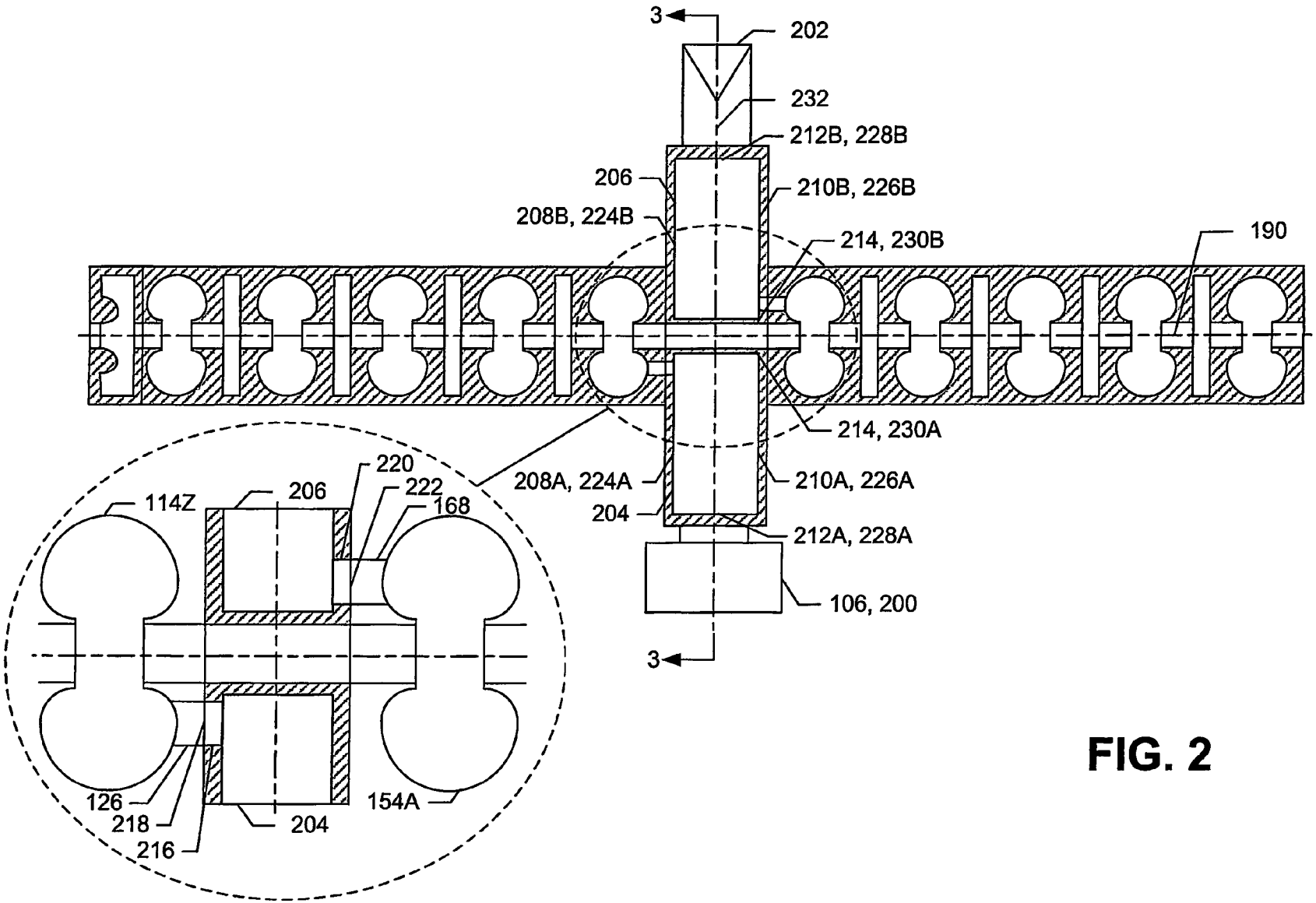
FIG. 2 displays a schematic sectional view of the particle accelerator system of FIG. 1 taken along lines 2—2.

FIG. 2 displays a schematic sectional view of the particle accelerator system 100 of FIG. 1 taken along lines 2—2. As seen more clearly in FIG. 2, the electromagnetic drive subsystem 106 comprises an RF generator 200, a waveguide load 202, a first feeder waveguide 204 and a second feeder waveguide 206. The RF generator 200 is operable to generate pulses of electromagnetic waves having an appropriate frequency and power level. Preferably, the RF generator 200 includes a klystron which generates electromagnetic waves having a frequency of 2856 MHz and 6 MW of power. Also preferably, the electromagnetic wave is a radio frequency (RF) electromagnetic wave. Alternatively, the RF generator 200 may include a magnetron or other devices for generating electromagnetic waves having an appropriate frequency and power level. The waveguide load 202 is adapted to receive reflections of electromagnetic waves during the rise and fall time of RF pulses. By receiving such reflections and dissipating the energy therein, the waveguide load 202 protects the RF generator 200 from the harmful effects of such reflections and the energy thereof.

As displayed in FIGS. 1 and 2, each feeder waveguide 204, 206 includes a portion thereof which is interposed between the second end 112 of the first accelerating section 102 and the first end 150 of the second accelerating section 104. Each feeder waveguide 204, 206, respectively, has, three side walls 208A, 208B, 210A, 210B, 212A, 212B and a common wall 214 which are, preferably, manufactured from a material such as, for example and not limitation, copper or other materials having similarly acceptable characteristics. Wall 208A of the first feeder waveguide 204 defines a passageway 216 extending therethrough having a slot 218 which aligns with the oblong-shaped slot 126 to enable electromagnetic waves and power in the first feeder waveguide 204 to propagate via the passageway 216, slot 218, and oblong-shaped slot 126 into the first accelerating section 102. Similarly, wall 210B defines a passageway 220 therethrough having a slot 222 which aligns with the oblong-shaped slot 168 to enable electromagnetic waves and power in the second feeder waveguide 206 to propagate via the passageway 220, slot 222, and oblong-shaped slot 168 into the second accelerating section 104.

In accordance with the exemplary embodiment described herein, the walls 208, 210, 212, 214 of the feeder waveguides 204, 206 define the waveguides 204, 206 to have, generally, rectangular cross-sections with each waveguide 204, 206 having, respectively, two parallel wide sides 224A, 226A, 224B, 226B and two parallel narrow sides 228A, 230A, 228B, 230B. Each wide side 224A, 226A, 224B, 226B has a length designated by dimension "A" (see FIG. 3) and each narrow side 228A, 230A, 228B, 230B has a width designated by dimension "B" (see FIG. 2), such that dimension "A" is greater than dimension "B". Preferably, the first feeder waveguide 204 is oriented with a portion of wall 208A and its first wide side 224A adjacent to the second end 112 of the first accelerating section 102 and with a portion of wall 210A and its second wide side 226A adjacent to the first end 150 of the second accelerating section 104. Similarly, the second feeder waveguide 206 is oriented with a portion of wall 208B and its first wide side 224B adjacent to the second end 112 of the first accelerating section 102 and with a portion of wall 210B and its second wide side 226B adjacent to the first end 150 of the second accelerating section 104. Also preferably, the wide sides 224A, 226A, 224B, 226B of the first and second feeder waveguides 204, 206 are respectively parallel due to the rectangular cross-section of the feeder waveguides 204, 206, are respectively perpendicular to the longitudinal axis 190 of the particle accelerator system 100, and define a transverse axis 232 of the particle accelerator system 100 midway therebetween which is also perpendicular to the longitudinal axis 190 of the particle accelerator system 100. Because portions of the feeder waveguides 204, 206 physically reside between the accelerating sections 102, 104, the particle accelerator system 100 is made to be more compact in the transverse direction (i.e., defined by the transverse axis 232) than other known particle accelerator systems 100. Further, because the feeder waveguides 204, 206 share a common wall 214, the particle accelerator system 100 is more compact in the longitudinal direction (i.e., defined by the longitudinal axis 190).

It should be understood that while the figures and accompanying description of the exemplary embodiment display and describe feeder waveguides 204, 206 that are oriented with their wide sides 224A, 224B, 226A, 226B respectively adjacent the second end 112 of the first accelerating section 102 and the first end 150 of the second accelerating section 104, the scope of the present invention further comprises feeder waveguides 204, 206 having their narrow sides 228A, 230A, 228B, 230B oriented respectively adjacent the second end 112 of the first accelerating section 102 and the first end 150 of the second accelerating section 104. Also, it should be understood that the scope of the present invention further comprises feeder waveguides 204, 206 having their wide sides 224A, 224B, 226A, 226B not perpendicular to the longitudinal axis 190 of the particle accelerator system 100, but at an angle other than ninety degrees to the longitudinal axis 190 of the particle accelerator system 100. Additionally, it should be understood that the scope of the present invention further comprises feeder waveguides 204, 206 having cross-sections which are not rectangular in shape, but instead have other shapes.

Figure 3:
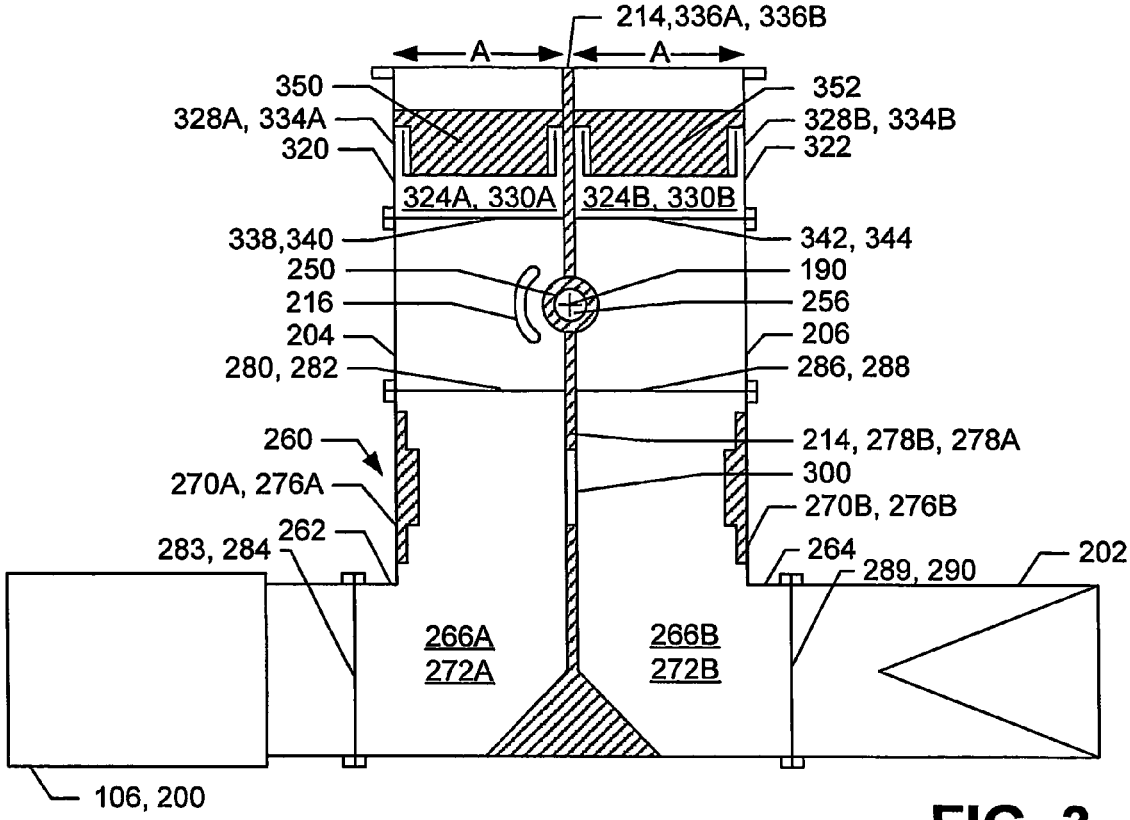
FIG. 3 displays a schematic sectional view of the electromagnetic drive subsystem of the particle accelerator system of FIG. 2 taken along lines 3—3.

FIG. 3 displays a schematic sectional view of the electromagnetic drive subsystem 106 of the particle accelerator system 100 of FIG. 2 taken along lines 3—3. As illustrated in FIG. 3, the common wall 214 of the feeder waveguides 204, 206 defines a drift tube 250 therein which is, preferably, centered about the longitudinal axis 190 of the particle accelerator system 100. The drift tube 250 has first and second ends 252, 254 and provides a passageway 256 for charged particles to travel between the first and second accelerating sections 102, 104. The first end 252 of the drift tube 250 abuts the output port 124 of the first accelerating section 102 and the input port 162 of the second accelerating section 104, thereby enabling the charged particles of a charged particle beam to travel, during operation of the particle accelerator system 100, from the first accelerating section 102 through output port 124, through passageway 256, and through input port 162 into the second accelerating section 104.

The electromagnetic drive subsystem 106 further comprises, as seen in FIG. 3, a 3 dB waveguide hybrid junction 260 which is connected to the feeder waveguides 204, 206, to the RF generator 200, and to the waveguide load 202. The 3 dB waveguide hybrid junction 260 includes a first waveguide 262 and a second waveguide 264 which are defined by respective walls 266A, 268A, 270A, 266B, 268B, 270B and by common wall 214 which the 3 dB waveguide hybrid junction 260, preferably, shares with the feeder waveguides 204, 206. Preferably, the first waveguide 262 has a, generally, rectangular cross-section with walls 266A, 268A forming wide sides 272A, 274A thereof and walls 270A, 214 forming narrow sides 276A, 278A thereof. Each wide side 272A, 274A has a length designated by dimension "A" (see FIG. 3) and each narrow side 276A, 278A has a width designated by dimension "B" (see FIG. 2), such that dimension "A" is greater than dimension "B". Walls 266A, 268A, 270A, 214 also define a first output opening 280 of the 3 dB waveguide hybrid junction 260 which mates with an input opening 282 of feeder waveguide 204 so that walls 266A, 268A, 270A are, respectively and preferably, coplanar with walls 208A, 210A, 212A of the first feeder waveguide 204 (and, hence, sides 272A, 274A, 276A, 278A of waveguide 262 are coplanar with sides 224A, 226A, 228A of the first feeder waveguide 204), thereby allowing electromagnetic waves and power to propagate from the first waveguide 262 of the 3 dB waveguide hybrid junction 260 into feeder waveguide 204 during operation of the particle accelerator system 100. Additionally, walls 266A, 268A, 270A, 214 also define an input opening 283 of the 3 dB waveguide hybrid junction 260 which mates with an output opening 284 of RF generator 200, thereby enabling electromagnetic waves and power to propagate from the RF generator 200 into the first waveguide 262 of the 3 dB waveguide hybrid junction 260 during operation of the particle accelerator system 100.

Similarly and preferably, the second waveguide 264 has a, generally, rectangular cross-section with walls 266B, 268B forming wide sides 272B, 274B thereof and walls 270B, 214 forming narrow sides 276B, 278B thereof. Each wide side 272B, 274B has a length designated by dimension "A" (see FIG. 3) and each narrow side 276B, 278B has a width designated by dimension "B" (see FIG. 2), such that dimension "A" is greater than dimension "B". Walls 266B, 268B, 270B, 214 also define a second output opening 286 of the 3 dB waveguide hybrid junction 260 which mates with an input opening 288 of feeder waveguide 206 so that walls 266B, 268B, 270B are, respectively and preferably, coplanar with walls 208B, 210B, 212B of the second feeder waveguide 206 (and, hence, sides 272B, 274B, 276B, 278B of waveguide 264 are coplanar with sides 224B, 226B, 228B of the second feeder waveguide 206), thereby allowing electromagnetic waves and power to propagate from the second waveguide 264 of the 3 dB waveguide hybrid junction 260 into feeder waveguide 206 during operation of the particle accelerator system 100. Additionally, walls 266B, 268B, 270B, 214 also define a third output opening 289 of the 3 dB waveguide hybrid junction 260 which mates with an input opening 290 of waveguide load 202, thereby enabling reflections of electromagnetic waves to propagate from the second waveguide 264 of the 3 dB waveguide hybrid junction 260 to the waveguide load 202 during operation of the particle accelerator system 100.

The portion of common wall 214 present in the 3 dB waveguide hybrid junction 260 defines a coupling window 300 which extends through the wall 214 and between first and second waveguides 262, 264 of the 3 dB waveguide hybrid junction 260. The coupling window 300 is adapted to allow, during operation of the particle accelerator system 100, electromagnetic waves and power received by the 3 dB waveguide hybrid junction 260 from the RF generator 200 to be divided to form first electromagnetic waves and second electromagnetic waves with the first electromagnetic waves having a first portion of the power of the received electromagnetic waves and the second electromagnetic waves having a second portion of the power of the received electromagnetic waves. The ratio of the first and second portions of the power of the received electromagnetic waves (and, hence, the ratio of the power of the first electromagnetic waves to the power of the second electromagnetic waves) is based, at least in part, upon the dimensions of the coupling window 300. The coupling window 300 is further adapted to direct reflections of the first electromagnetic waves, received from the first accelerating section 102 via feeder waveguide 204 and first waveguide 262, into second waveguide 264. By virtue of the coupling window 300 being positioned in narrow sides 278A, 278B of first and second waveguides 262, 264 (i.e., as opposed to being positioned in wide sides 272A, 274A, 272B, 274B), the electric field at the edges of the coupling window 300 are zero and, as a consequence, the electric field of the 3 dB waveguide hybrid junction 260 is maximal (i.e., and corresponds to the maximal power of a waveguide without a coupling window 300 therein) and is not limited by the high electric fields which would, otherwise, be present at the edges of the coupling window 300 if the coupling window 300 were positioned in a wide side 272A, 274A, 272B, 274B of the first and second waveguides 262, 264.

The 3 dB waveguide hybrid junction 260 is configured to direct, during operation of the particle accelerator system 100, the first electromagnetic waves and associated power through first waveguide 262 and first output opening 280 into feeder waveguide 204 and to direct the second electromagnetic waves and associated power through second waveguide 264 and second output opening 286 into feeder waveguide 206. The 3 dB waveguide hybrid junction 260 is further configured to direct reflections of the first electromagnetic waves received by the second waveguide 264 via coupling window 300 and reflections of the second electromagnetic waves received, from the second accelerating section 104 via feeder waveguide 206 and second waveguide 264, to the waveguide load 202 via third output opening 289 during operation of the particle accelerator system 100. Because the 3 dB waveguide hybrid junction 260 is connected directly and linearly to the feeder waveguides 204, 206 that supply electromagnetic waves and associated power to the accelerating sections 102, 104, there are no additional waveguides and no waveguide turns, or bends, necessary to couple the 3 dB waveguide hybrid junction 260 with the accelerating sections 102, 104. As a consequence, the overall size of the particle accelerator system 100 is reduced in comparison to the size of other known particle accelerator systems which require additional waveguides and/or waveguide turns, or bends, to couple accelerating sections with an RF generator.

The electromagnetic drive subsystem 106 further comprises, as seen in FIGS. 2 and 3, a pair of shorting waveguides 320, 322 which are connected, respectively, to feeder waveguides 204, 206. The first and second shorting waveguides 320, 322 are defined by respective walls 324A, 326A, 328A, 324B, 326B, 328B and by common wall 214 which the shorting waveguides 320, 322, preferably, share with the feeder waveguides 204, 206. Preferably, the first shorting waveguide 320 has a, generally, rectangular cross-section with walls 324A, 326A forming wide sides 330A, 332A thereof and walls 328A, 214 forming narrow sides 334A, 336A thereof. Each wide side 330A, 332A has a length designated by dimension "A" (see FIG. 3) and each narrow side 334A, 336A has a width designated by dimension "B" (see FIG. 2), such that dimension "A" is greater than dimension "B". Walls 324A, 326A, 328A, 214 also define an input opening 338 of the first shorting waveguide 320 which mates with an output opening 340 of feeder waveguide 204 (defined by walls 208A, 210A, 212A, 214 of feeder waveguide 204) so that walls 324A, 326A, 328A are, respectively and preferably, coplanar with walls 208A, 210A, 212A of feeder waveguide 204 (and, hence, sides 330A, 332A, 334A, 336A of shorting waveguide 320 are coplanar with sides 224A, 226A, 228A of feeder waveguide 204), thereby allowing the first electromagnetic waves and associated power to propagate from feeder waveguide 204 into shorting waveguide 320 during operation of the particle accelerator system 100.

Similarly and preferably, the second shorting waveguide 322 has a, generally, rectangular cross-section with walls 324B, 326B forming wide sides 330B, 332B thereof and walls 328B, 214 forming narrow sides 334B, 336B thereof. Each wide side 330B, 332B has a length designated by dimension "A" (see FIG. 3) and each narrow side 334B, 336B has a width designated by dimension "B" (see FIG. 2), such that dimension "A" is greater than dimension "B". Walls 324B, 326B, 328B, 214 also define an input opening 342 of the first shorting waveguide 322 which mates with an output opening 344 of feeder waveguide 206 (defined by walls 208B, 210B, 212B, 214 of feeder waveguide 206) so that walls 324B, 326B, 328B are, respectively and preferably, coplanar with walls 208B, 210B, 212B of feeder waveguide 204 (and, hence, sides 330B, 332B, 334B, 336B of shorting waveguide 322 are coplanar with sides 224B, 226B, 228B of feeder waveguide 206), thereby allowing the second electromagnetic waves and associated power to propagate from feeder waveguide 206 into shorting waveguide 322 during operation of the particle accelerator system 100.

Figure 4:
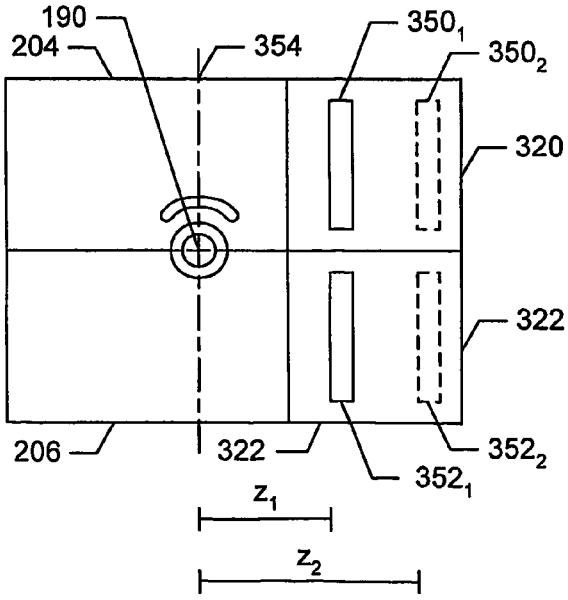
FIG. 4 displays a pictorial view of the feeder and shorting waveguides of the electromagnetic drive subsystem of FIG. 3.

Each shorting waveguide 320, 322 includes therein a shorting device 350, 352 which is positioned in its respective shorting waveguide 320, 322 at a location (i.e., a shorting plane) at which the longitudinal axis 190 of the particle accelerator system 100 (and, hence, the longitudinal axis of accelerating sections 102, 104 and accelerating and coupling cavities 114, 116, 154, 156 thereof) is between the shorting device 350, 352 and the coupling window 300 of the 3 dB waveguide hybrid junction 260. Preferably, each shorting device 350, 352 comprises a substantially rectangular-shaped shorting plunger having a choke groove formed therein as illustrated in FIGS. 3 and 4. Each shorting device 350, 352 is, preferably, movable, prior to startup of the particle accelerator system 100, into one of a plurality of positions (i.e., shorting planes) which are each uniquely identified by their respective distance, "z", from a cross-sectional plane 354 of the feeder waveguides 204, 206 in which the longitudinal axis 190 of the particle accelerator system 100 lies (i.e., from the longitudinal axis 190 of the particle accelerator system 100).

FIG. 4 displays the shorting devices 350, 352 in two such positions with the shorting devices 350, 352 being identified as shorting devices $\mathbf{350}_1$ $\mathbf{352}_1$ when in the first position at a distance "$z_1$" relative to cross-sectional plane 354 of the feeder waveguides 204, 206 and as shorting devices $\mathbf{350}_2$, $\mathbf{352}_2$ when in the second position at a distance "$Z_2$" relative to cross-sectional plane 354 of the feeder waveguides 204, 206. When the shorting devices 350, 352 are positioned in the first position and in the second positions, the coupling coefficients, "k", of feeder waveguides 204, 206 with accelerating sections 102, 104 are different. Thus, by moving the shorting devices 350, 352 into a plurality of positions (i.e., shorting planes) relative to cross-section plane 354 (and, hence, at a plurality of distances from the longitudinal axis 190 of the particle accelerator system 100), the coupling coefficients, "k", may be changed to a corresponding plurality of values which are related to the plurality of positions on a one-to-one basis. Because there is only one value of the coupling coefficients, "k", of feeder waveguides 204, 206 with accelerating sections 102, 104 at which all power of the first and second electromagnetic waves is delivered to accelerating sections 102, 104 without reflections and is maximally utilized for charged particle acceleration for each charged particle beam current at which the particle accelerator system 100 may be operated, the ability to move the shorting devices 350, 352 into a plurality of positions allows optimal setting of the coupling coefficients, "k", for any charged particle beam current.

Figure 5:
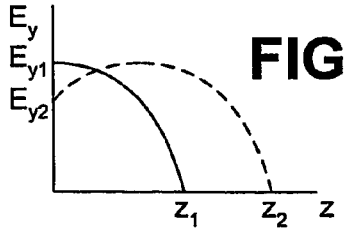
FIG. 5 displays a graphical illustration of the relationship between the shorting device position and the electric field magnitude at the longitudinal axis of the particle accelerator system in accordance with the exemplary embodiment of the present invention.

FIG. 5 displays a graphical illustration of the effect of moving the shorting devices 350, 352 relative to cross-section plane 354 to different distances, "z", therefrom on the magnitude of the transverse component of the electric field, "$E_y$", produced at the cross-section plane 354 (i.e., at z=0) with the shorting devices 350, 352 at such distances. The relationship is set forth mathematically as $E_y=E_0 \sin(k(z_0-z))$, where: $E_0$ corresponds to the maximum possible magnitude of the transverse component of the electric field at cross-section plane 354 of the feeder waveguides 204, 206; "k" corresponds to the coupling coefficients of feeder waveguides 204, 206 with accelerating sections 102, 104; $z_0$ corresponds to the distance of the shorting devices 350, 352 relative to cross-sectional plane 354 of the feeder waveguides 204, 206 at which the transverse component of the electric field, "$E_y$", has its maximum possible magnitude; and, "z" corresponds to the actual distance of the shorting devices 350, 352 relative to cross-section plane 354 of the feeder waveguides 204, 206. In FIG. 5, the solid curve is associated with the case in which the shorting devices 350, 352 are positioned at a distance from cross-section plane 354 with the magnitude of the transverse component of the electric field, "$E_y$", produced at the cross-section plane 354 being a maximum, which corresponds to the maximal coupling coefficient, "k". If the actual distance, "z", is such that the transverse component of the electric field, "$E_y$", equals zero (i.e., the minimum possible magnitude) in plane 354, the coupling coefficient, "k", equals zero (i.e., the minimal coupling coefficient). The actual position of the shorting devices 350, 352 is selected to be between these two extreme values so that coupling coefficient, "k", is controllable. In this case, at the operating beam current value, all power of the first and second electromagnetic waves is delivered to accelerating sections 102, 104 without reflections in feeder waveguides 204, 206. The dashed curve is associated with a case in which the shorting devices 350, 352 are positioned at some interim distance from cross-section plane 354 and, hence, the magnitude of the transverse component of the electric field, "$E_y$", produced at the cross-section plane 354 is not at a maximum.

Figure 6:
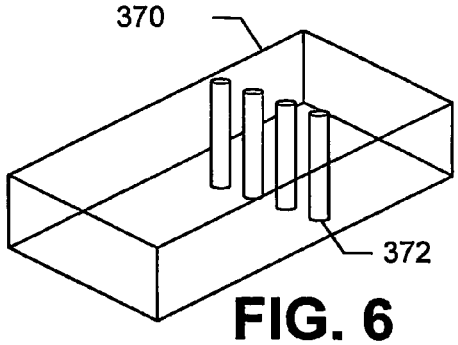
FIG. 6 displays a schematic perspective view of an alternative shorting waveguide in accordance with the exemplary embodiment of the present invention.

While the shorting devices 350, 352 of the exemplary embodiment described herein are movable between a plurality of positions in shorting waveguides 320, 322 that correspond to a plurality of different distances, "z", relative to cross-section plane 354, FIG. 6 displays a front perspective view of a shorting waveguide 370 which may be used in place of the shorting waveguides 320, 322. Shorting waveguide 370 has dimensions that are substantially similar to those of shorting waveguides 320, 322, thereby enabling a shorting waveguide 370 to be secured to each feeder waveguide 204, 206 in replacement of shorting waveguides 320, 322. Preferably, shorting waveguide 370 comprises a plurality of rods 372 which are secured to an appropriate side 374 of shorting waveguide 370 at a location which results in the rods 372 being positioned at a distance, "z", relative to cross-section plane 354 (i.e., in a shorting plane) when a shorting waveguide 370 is secured to feeder waveguide 320, 322 that causes the coupling coefficients, "k", of feeder waveguides 204, 206 with accelerating sections 102, 104 to have a value at which all power of the first and second electromagnetic waves is delivered to accelerating sections 102, 104 without reflections and is maximally utilized for charged particle acceleration when the particle accelerator system 100 is operated at a corresponding charged particle beam current. If the particle accelerator system 100 is to be operated at a different charged particle beam current, a shorting waveguide 370 having rods 372 at different locations may be employed to optimize the coupling coefficients and to efficiently utilize power of the first and second electromagnetic waves without reflections.

An exemplary particle accelerator system 100, acceptable in accordance with the embodiment described herein, comprises a klystron RF generator 200 having a 6 MW pulse power and a 2856 MHz operating frequency. The charged particle beam current of such particle accelerator system 100 may be changed within the range of 0.1 A to 0.7 A. The coupling coefficients of the feeder waveguides 204, 206 and accelerating sections 102, 104 of such particle accelerator system 100 may be changed within the range of 1.5 to 5.0 by moving movable shorting devices 350, 352 thereof into appropriate positions as described above.

Prior to operation of particle accelerator system 100, shorting devices 350, 352 are positioned at locations appropriate to optimally set the coupling coefficients between the feeder waveguides 204, 206 and the accelerating sections 102, 104 so that all power of the first and second electromagnetic waves is delivered to accelerating sections 102, 104 without reflections for the charged particle beam current at which the particle accelerator system 100 is to be operated. Once the particle accelerator system 100 is in operation, injector 108 generates and emits charged particles (preferably, electrons) into the first accelerating section 102 and, concurrently, the RF generator 200 of the electromagnetic drive subsystem 106 generates electromagnetic waves which are directed into the 3 dB waveguide hybrid junction 260 thereof. After the generated electromagnetic waves and associated power are divided by the coupling window 300, a first portion of the generated electromagnetic waves (the "first electromagnetic waves") and associated power propagates through the first waveguide 262 of the 3 dB waveguide hybrid junction 260 and into the first feeder waveguide 204. A second portion of the generated electromagnetic waves (the "second electromagnetic waves") and associated power propagates through the coupling window 300, into the second waveguide 264 of the 3 dB waveguide hybrid junction 260, and then into the second feeder waveguide 206. Subsequently, the first and second electromagnetic waves and associated power propagate, respectively, into and throughout the accelerating sections 102, 104 via the oblong-shaped slots 126, 168.

Any reflections of the first and second electromagnetic waves occurring during the transient startup period are directed from the first and second feeder waveguides 204, 206 into the second waveguide 264 of the 3 dB waveguide hybrid junction 260 (either directly from the second feeder waveguide 206 or indirectly from the first waveguide 204 via the first feeder waveguide 262 and coupling window 300 of the 3 dB waveguide hybrid junction 260). Once within the second waveguide 264 of the 3 dB waveguide hybrid junction 260, the reflections are directed to the waveguide load 202 where the energy thereof is dissipated, resulting in their absorption.

Contemporaneously, the charged particles emitted into the first accelerating section 102 travel through the accelerating cavities 114, coupling cavities 116, and drift tubes 118 thereof while being accelerated by the energy of the first electromagnetic waves and formed into a charged particle beam. Upon reaching the second end 112 of the first accelerating section 102, the charged particles of the charged particle beam travel through output port 124 and into the drift tube 250 formed in the common wall 214 of the first and second feeder waveguides 204, 206 of the electromagnetic drive subsystem 106. After traveling through the drift tube 250, the charged particles of the charged particle beam enter the second accelerating section 104, via input port 162, and travel through the accelerating cavities 154, coupling cavities 156, and drift tubes 158 thereof while being further accelerated by the energy of the second electromagnetic waves. The charged particles of the charged particle beam exit the particle accelerator system 100 at output port 166 located at the second end 152 thereof.

Whereas the present invention has been described in detail above with respect to an embodiment thereof, it is understood that variations and modifications can be effected within the spirit and scope of the invention, as described herein before and as defined in the appended claims. The corresponding structures, materials, acts, and equivalents of all means-plus-function elements, if any, in the claims below are intended to include any structure, material, or acts for performing the functions in combination with other claimed elements as specifically claimed.

What is claimed is:

1. A particle accelerator comprising:

an injector for generating charged particles;

an electromagnetic drive subsystem for generating pulses of electromagnetic waves;

a first accelerating section adapted to receive said electromagnetic waves and to transfer energy from said electromagnetic waves to said charged particles as said charged particles travel therethrough;

a second accelerating section adapted to transfer energy to said charged particles as said charged particles travel therethrough;

a waveguide connected to said electromagnetic drive subsystem and adapted to deliver said electromagnetic waves from said electromagnetic drive subsystem to said first accelerating section, said waveguide having a wall at least partially physically interposed between said first accelerating section and said second accelerating section;

a 3 dB waveguide hybrid junction formed at least partially from said wall, said 3 dB waveguide hybrid junction defining a coupling window in said wall; and a tube connected to and extending between said first accelerating section and said second accelerating section, said tube being adapted to enable said charged particles to travel between said first accelerating section and said second accelerating section.

2. The particle accelerator of claim 1, wherein said tube is defined within said wall.

3. The particle accelerator of claim 1, wherein said waveguide is a first waveguide and said particle accelerator further comprises a second waveguide connected to said electromagnetic drive subsystem; said second waveguide being at least partially physically interposed between said first accelerating section and said second accelerating section.

4. The particle accelerator of claim 3, wherein said first waveguide and said second waveguide share a common wall therebetween.

5. A particle accelerator comprising:

an injector for generating charged particles;

an electromagnetic drive subsystem for generating pulses of electromagnetic waves;

a first accelerating section adapted to receive said electromagnetic waves and to transfer energy from said electromagnetic waves to said charged particles as said charged particles travel therethrough;

a second accelerating section adapted to transfer energy to said charged particles as said charged particles travel therethrough;

a first waveguide connected to said electromagnetic drive subsystem and adapted to deliver said electromagnetic waves from said electromagnetic drive subsystem to said first accelerating section, said first waveguide being at least partially physically interposed between said first accelerating section and said second accelerating section;

a second waveguide connected to said electromagnetic drive subsystem, said second waveguide being at least partially physically interposed between said first accelerating section and said second accelerating section, said second waveguide and said first waveguide sharing a common wall therebetween; and a tube connected to and extending between said first accelerating section and said second accelerating section, said tube being defined within said shared common wall and being adapted to enable said charged particles to travel between said first accelerating section and said second accelerating section.

6. A particle accelerator comprising:

an injector for generating charged particles;

a radio frequency generator for generating pulses of electromagnetic waves;

a first accelerating section adapted to receive said electromagnetic waves and to transfer energy from said electromagnetic waves to said charged particles as said charged particles travel therethrough, said first accelerating section defining a longitudinal axis thereof;

a second accelerating section adapted to transfer energy to said charged particles as said charged particles travel therethrough;

a 3 dB waveguide hybrid junction having a first waveguide and a second waveguide sharing a common wall therebetween, said wall defining a coupling window therein, said first waveguide defining a longitudinal axis thereof substantially perpendicular to said longitudinal axis of said first accelerating section, said first waveguide being connected to said first accelerating section and said second waveguide being connected to said second accelerating section, said first waveguide being connected to said radio frequency generator; and, a shorting waveguide connected to said first waveguide of said 3 dB waveguide hybrid junction and having a shorting device therein positioned such that said longitudinal axis of said first accelerating section is substantially between said shorting device and said coupling window.

7. The particle accelerator of claim 6, wherein said common wall comprises a first narrow wall of said first waveguide of said 3 dB waveguide hybrid junction and said 3 dB waveguide hybrid junction further comprises a second narrow wall opposing said first narrow wall, a first wide wall, and a second wide wall opposing said first wide wall.

8. A particle accelerator comprising:

an injector for generating charged particles:

an electromagnetic drive subsystem for generating pulses of electromagnetic waves;

a first accelerating section adapted to receive said electromagnetic waves and to transfer energy from said electromagnetic waves to said charged particles as said charged particles travel therethrough;

a second accelerating section adapted to transfer energy to said charged particles as said charged particles travel therethrough;

a waveguide connected to said electromagnetic drive subsystem and adapted to deliver said electromagnetic waves from said electromagnetic drive subsystem to said first accelerating section, said waveguide having a wall and being at least partially physically interposed between said first accelerating section and said second accelerating section; and, a tube connected to and extending between said first accelerating section and said second accelerating section, said tube being formed within said wall and being adapted to enable said charged particles to travel between said first accelerating section and said second accelerating section.

* * * * *